United States Patent [19]

Shoberg

[11] 4,254,976

[45] Mar. 10, 1981

[54] DOOR RESTRAINT MECHANISM

[76] Inventor: Harold A. Shoberg, 1208 E. Seldon La., Phoenix, Ariz. 85020

[21] Appl. No.: 81,479

[22] Filed: Oct. 3, 1979

[51] Int. Cl.[3] ..... E05C 19/18

[52] U.S. Cl. ..... 292/292; 292/258

[58] Field of Search ..... 292/258, 288, 292, 293–298

[56] References Cited

U.S. PATENT DOCUMENTS

| | | | |
|---|---|---|---|
| 390,130 | 9/1888 | Longenecker | 292/292 |
| 1,239,802 | 9/1917 | Macbeth | 292/258 |
| 1,571,543 | 2/1926 | Fratyke | 292/258 |
| 2,396,982 | 3/1946 | Bousquet | 292/258 X |
| 4,025,096 | 5/1977 | Geer | 292/341.18 |
| 4,155,578 | 5/1979 | Rolland | 292/292 |

*Primary Examiner*—Richard E. Moore

*Attorney, Agent, or Firm*—Cahill, Sutton & Thomas

[57] ABSTRACT

A door restraint mechanism for preventing the opening of a door positioned in a doorway having a jamb, the door including a handle. A pair of frame members are each provided with a compression spring for transmitting force to a door handle shoe. An over-center lever compresses the spring to exert force between the door handle shoe abutting the door handle and a pressure face secured to said frame and positioned against said door jamb. The pressure face tightly grips the door jamb and prevents the door from being opened.

9 Claims, 8 Drawing Figures

DOOR RESTRAINT MECHANISM

The present invention pertains to door restraint mechanisms, and more particularly, to devices that may be placed on a door to engage the door and frictionally engage the door jamb to effectively secure the door in a doorway without regard to the effectiveness of a conventional door lock.

There are enumerable devices provided in the prior art for preventing the opening of a door and thereby securing the respective room against intrusion. Such prior art devices have been typically directed to means for implementing locking devices mounted on the door or door jamb and which are operated through conventional means such as keys, knobs, or slides (i.e., chain locks). Not withstanding the sophistication of some of these prior art devices, entry can be gained into the room by sophisticated intruders through the use of a variety of equipment, including pass keys, chain cutters, and tools designed for such purposes. Such intrusion is particularly dangerous when the occupants of the room are present and for various reasons are unable to defend themselves against such intruders.

Individuals who are required to travel are usually confronted with situations wherein locking devices provided at these temporary dwellings are inadequate to prevent intrusion by a determined burglar.

It is therefore an object of the present invention to provide a door restraint mechanism that may be used to supplement conventional door locking devices to prevent the opening of a door.

It is another object of the present invention to provide a door restraint mechanism that is easily portable and can be conveniently carried by the traveler to be used to prevent the opening of doors without regard to the conventional door locking mechanisms provided by the innkeeper.

It is still another object of the present invention to provide a portable door restraint mechanism that may be used to prevent the opening of a door by application of the mechanism to an existing door jamb and door handle without regard to whether the door opens inwardly or outwardly.

It is yet another object of the present invention to provide a door restraint mechanism that may be used as a door restraint mechanism in one's home as a semi-permanent locking device while nevertheless being readily convertible to a portable door restraint mechanism for universal application to a variety of door arrangements.

These and other objects of the present invention will become more readily apparent to those skilled in the art as the description thereof proceeds.

Briefly, in accordance with the embodiment chosen for illustration, a door restrain mechanism is provided with a pair of frame members that are secured in parallel relationship with respect to each other and which support a pressure face at one end thereof. A movable door handle shoe is mounted between the frame members and is positioned between the pressure face and a door handle. An actuating lever is pivotally secured to the frame members and may be pivoted to apply pressure through compression springs to the door handle shoe to force the shoe against the door handle and correspondingly apply force to the door jamb through the pressure face. The force thus applied tending to push the door (through the door handle) away from the door jamb, results in substantial frictional engagement between the pressure face of the door jamb. The force is sufficient to effectively prevent the door from being opened regardless of the position of the door bolt or other door locking mechanisms.

The present invention may be more readily described with reference to the following drawings, in which.

Figure 1:
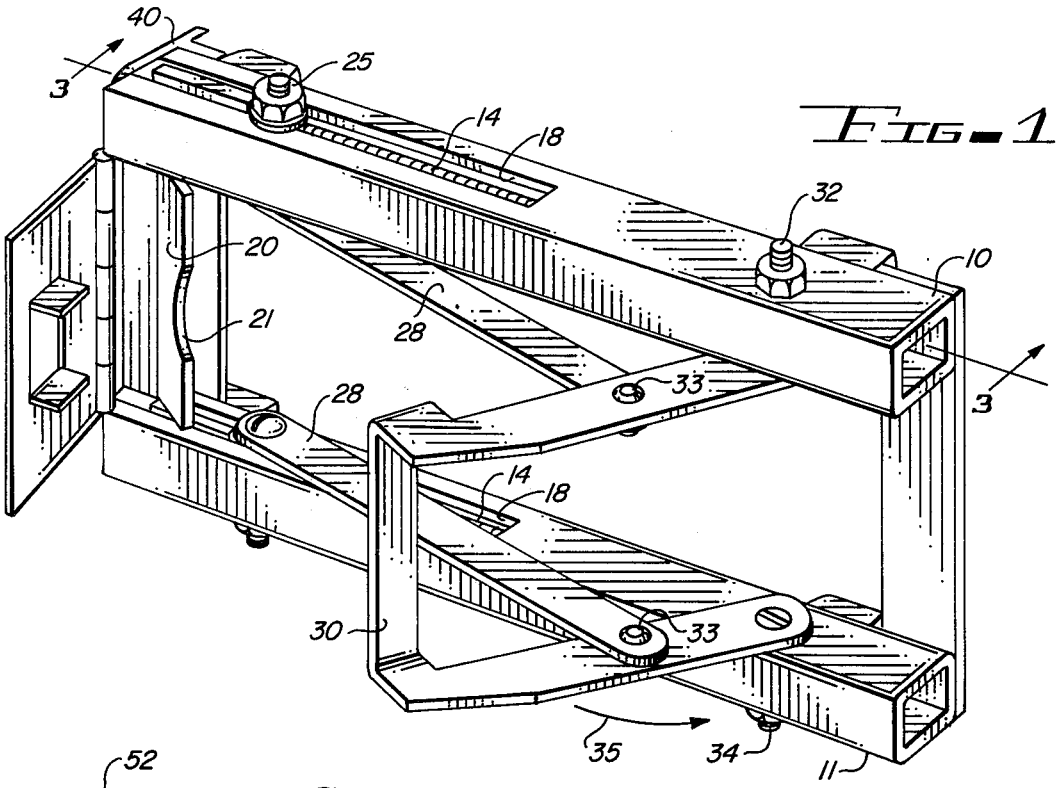
FIG. 1 is a perspective view of a door restraint mechanism constructed in accordance with the teachings of the present invention.
Figure 4:
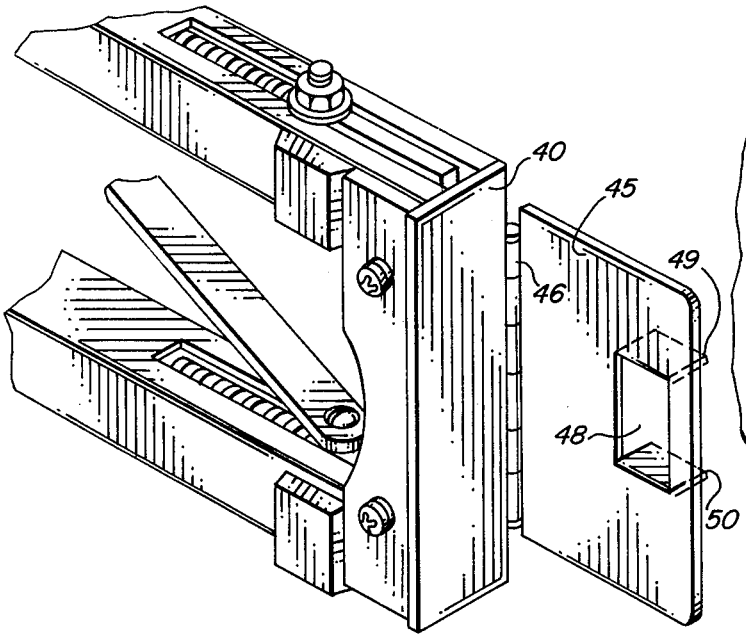
FIG. 4 is a perspective view of a portion of the device of FIG. 1 showing the pressure face of the mechanism.
Figure 3:
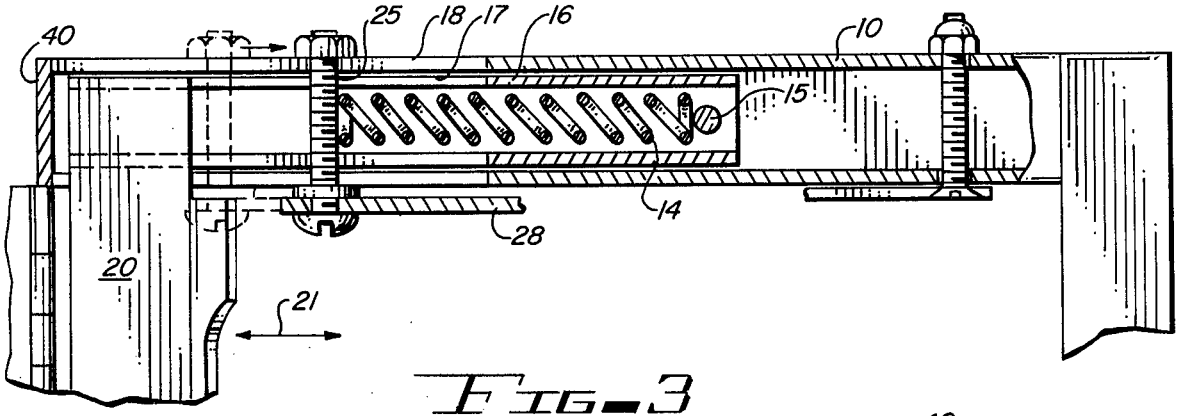
FIG. 3 is a cross-sectional view, partly broken away, of FIG. 1, taken along line 3—3.

Referring now to FIGS. 1, 3 and 4, the mechanism of the present invention includes an upper tubular frame member 10 and a lower tubular frame member 11 secured to each other and spaced apart parallel. Each of the frame members 10 and 11 include a compression spring 14 therewithin that abuts a pin, such as that shown at 15, secured to a slide 16 within the respective tubular frame member. The slide 16 is provided with a longitudinal extending slot 17 coinciding with a corresponding longitudinal extending slot 18 into tubular frame members 10 and 11. The slide 16 is attached to a door handle shoe 20 that may include an arcuate cut-out portion 21 for purposes to be described more fully hereinafter. The door handle shoe 20 is thus free to move in the direction of the arrow 21 within the slot 18 provided in the tubular members.

The spring 14, acting in compression, therefore exhibits a tendency to move the pin 15 and thus the slide 16 and door handle shoe 20, to the right, as shown in FIGS. 1 and 3. The spring 14 is compressed by abuttment against a spring actuating bolt 25 which, while free to slide in the slot 18 provided in the frame members, abuts one end of spring 14 and moves within slot 18 by an actuating arm 28.

The actuating arm 28 (of which there are two, one upper and one lower, each corresponding to a frame member 10 and 11, respectively) from a part of a lever actuating mechanism, including an actuating lever 30. The lever 30 is pivoted to the frame members 10 and 11 at 32 and 34, respectively, and is also pivotally attached to the actuating arms 28 at pivots 33. Thus, movement of the actuating lever 30 in the direction of arrow 35 will cause the actuation arms 28 and corresponding spring actuating bolts 25 to compress springs 14 within each of the frame members. The compressive force will act upon pins 15 to cause the door handle shoe 20 to move toward the right, as viewed in FIGS. 2 and 3.

A pressure face 40 extends between the frame members 10 and 11 and is positionable against a door jamb, as will be described. As an alternate and supplemental means for restraining the door when the door is an inwardly opening door, an auxiliary pressure face plate 45 will be swung into contact with pressure face 40 about hinge 46. The auxiliary pressure face plate 45 then becomes the pressure face while also incorporating an opening 48 to accommodate the passage of a door bolt therethrough. Wings 49 and 50 extend adjacent opening 48 to extend into the opening in a striker plate, as will be described later.

Figure 2A:
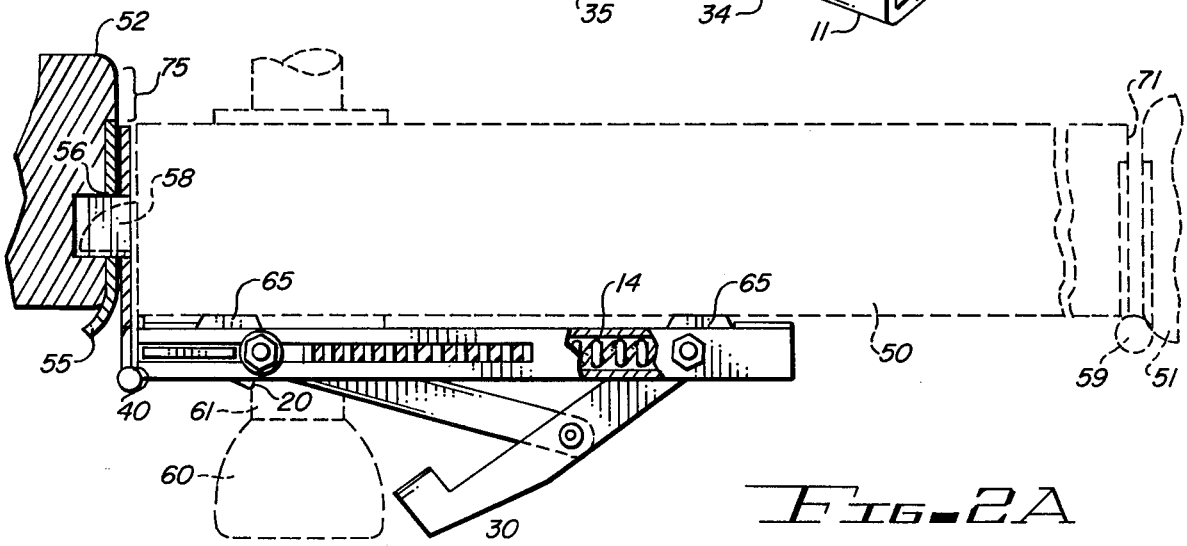
FIGS. 2A and 2B are top views, partly broken away, of the door restraint mechanism of the present invention, showing the mechanism in place in an unlocked and locked position, respectively.
Figure 2B:
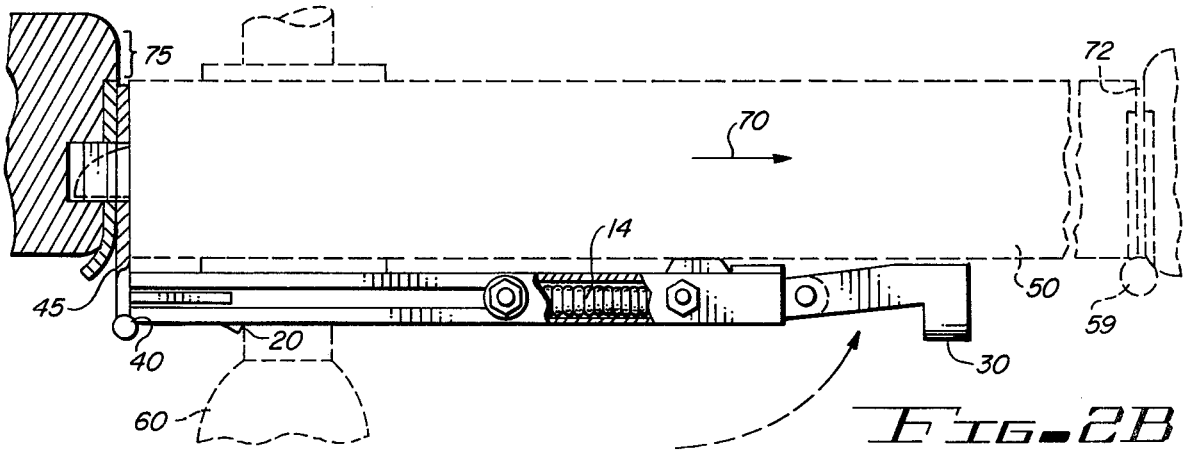

Referring now to FIGS. 2A and 2B, the present invention may be described in connection with a door whose opening is to be restrained. The door 50 is positioned within a doorway defined by a door frame 51 and a door jamb 52. The jamb includes a striker plate 55 provided with an opening 56 to receive the door bolt 58. The door is mounted on conventional hinges 59 and is provided with a door handle 60. As used herein, the term "door handle" does not necessarily mean only the gripping portion of the door handle but may also include the stem portion, such as that shown at 61, of the handle extending from the door. It will be obvious to those skilled in the art that a great variety of door handles will be encountered, including various sizes and shapes, as well as various distances between the centerline of the door handle and the edge of the door (this latter dimension is generally standardized such that a limited range of edge-to-handle dimensions will include practically all doors used in modern day construction).

The tubular frame members 10 and 11 are placed over door handle 60 in straddling fashion with the pressure face 40 or auxiliary pressure face plate 45 in abutting contact with door jamb 52. When placed in this position, the door handle shoe 20 is between the door handle 60 and the pressure face 40. When the actuating lever 30 is in the position shown in FIG. 2A, the door is in its unrestrained position and may be opened simply by turning door handle 60 to withdraw bolt 58. When the lever 30 is moved to the position shown in FIG. 2B, the springs 14 become compressed and exert a force tending to separate the door handle shoe 20 from the pressure face 40 or, as in the case of FIGS. 2A and 2B, from the auxiliary pressure face plate 45.

It may be noted that rubber-like contact legs 65 are provided to contact the door to prevent marring the surface thereof. It may also be noted that when lever 30 has been moved to the position shown in FIG. 2B that it is in an over-center position such that the force exerted by spring 14 retains the lever in its position shown in FIG. 2B.

The force exerted by springs 14 in the tubular frame members 10 and 11 jamb the door handle shoe 20 into the door handle 60 (or the stem 61) and jambs the door in the direction indicated by arrow 70 toward the door hinges. The slight movement of the door in the direction of arrow 70 can be observed such that the normal gap 71, as shown in FIG. 2A, is slightly reduced, as shown in FIG. 2B. The force thus generated effectively prevents the opening of the door even through the bolt 58 may be withdrawn from the opening provided thereof in the striker plate 55. This force restraining the opening of the door is sufficient even if the wings 49 and 50 are removed from the auxiliary pressure face plate 45.

In the example shown in FIGS. 2A and 2B, it may be noted that the door is an inward opening door; that is, the door restrain mechanism of the present invention is mounted on the side of the door toward which the door opens. In those instances where the door opens in the opposite direction or outwardly (i.e., the "inside" of the room is represented at the top of FIGS. 2A and 2B rather than the bottom thereof), the mechanism of the present invention is simply mounted on the other side of the door. In the latter instance, the auxiliary pressure face plate 45 is simply hinged out of the way, as shown in FIG. 1, and the pressure plate 40 placed against the exposed surface 75 of the door jamb 52. The operation of the restrain mechanism is otherwise identical to that described above. A very interesting and unexpected advantage of the mechanism that is particularly useful in those instances where the door is an outwardly opening door is the fact that the force exerted by the door restraining member applies sufficient force against the hinges that the hinge pins of the respective hinges cannot be removed. Thus, even though a prospective intruder attempts to gain entry through an outwardly opening door by removing the hinges, his plans would be thwarted by the operation of the present invention.

Figure 7:
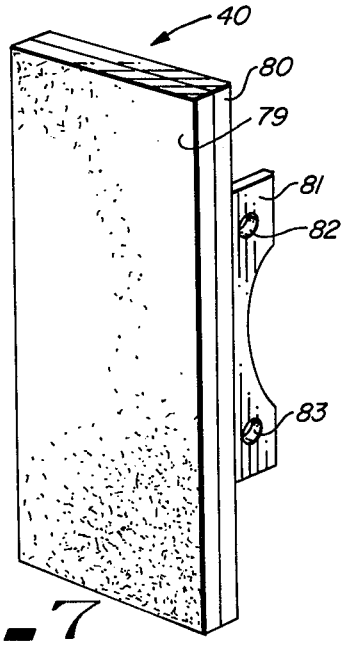
FIG. 7 is an enlarged perspective view of the pressure face of the apparatus of the present invention.

The pressure face 40 is shown in greater detail in FIG. 7 wherein it may be seen that the face compresses a layer 79 of tough resilient material, such as rubber, that is bonded to a steel backing plate 80 having a suitable bracket 81 welded thereto and provided with openings 82 and 83 for fastening to the frame members 10 and 11. The rubber-like layer 79 performs the function of gripping the door jamb to significantly increase the coefficient of friction between the pressure face of the door jamb while nevertheless preventing marring or other defacement of the jamb. In some instances, it may be desirable to mold or otherwise form a pattern into layer 79 to further increase its frictional gripping capabilities.

Figure 5:
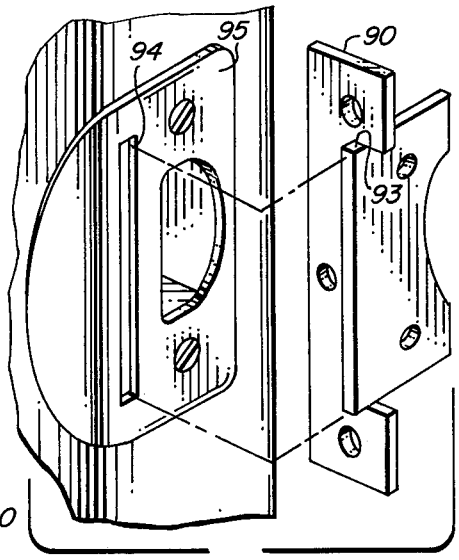
FIG. 5 is a perspective view of an alternative pressure face for use with the mechanism of the present invention.
Figure 6:
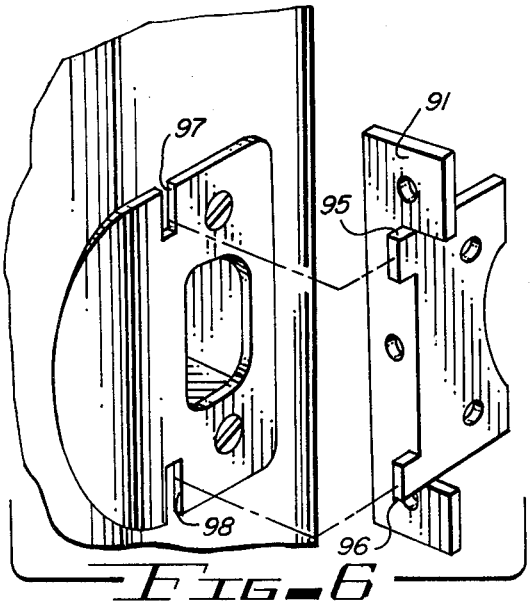
FIG. 6 is another alternative perspective view of the pressure face for use with the mechanism of the present invention.

In those instances where the door restraint mechanism of the present invention is to be used as a semi-permanent installation while nevertheless preserving its advantages as a portable restraint mechanism, the pressure face 40, as shown in FIG. 7, may be replaced by pressure faces 90 and 91 shown in FIGS. 5 and 6, respectively. Referring to FIG. 5, pressure face 90 incorporates a protrusion 93 for extension into a corresponding slot 94 provided therefor in the striker plate 55. Alternatively, the embodiment shown in FIG. 6 may be used wherein a pair of protrusions 95 and 96 are used to made with corresponding slots 97 and 98, respectively. If the pressure faces of FIGS. 5 and 6 are used, it will be obvious to those skilled in the art that matching striker plates will have to be used. The protrusions and matching striker plates add an additional modicum of restraint and may be used for applications in the home. When the restraint mechanism of the present invention is to accompany the owner and is to be used on a variety of doors which are not equipped with the special striker plates, the pressure faces 90 or 91 may simply be removed and replaced with the pressure face 40, as shown in FIG. 7, with or without a hingedly attached auxiliary pressure face plate, as shown at 45.

The restraint mechanism may thus be used on an inwardly or outwardly opening door and will restrain the door from opening by the force applied between the door jamb and the door handle. This force will also prevent hinge pins being removed from exposed hinges. Although not the primary purpose of the restraint mechanism, the door handle shoe 20 also tends to restrain the rotation of the door handle, thus rendering it more difficult to retract the bolt, even though the door may not be locked by conventional means.

It will be obvious to those skilled in the art that a variety of lever mechanism will be used, as well as various spring arrangements, to provide the necessary force to restrain the door. It will also be obvious to those skilled in the art that suitable adjustments can be built into the device to provide a wider range of accommodation to varying door sizes, although the spring system shown in the drawings is believed to accommodate most of the standard door handle arrangements presently in use.

I claim:

1. A door restraint mechanism for preventing the opening of a door positioned in a doorway having a jamb, said door including a handle, comprising:

a. a frame member having a pressure face for placement against said jamb;

b. a door handle shoe mounted for movement along said frame and positioned on said frame between said pressure face and said door handle, and abutting said door handle; and c. lever actuated means, secured to said frame, to apply force tending to move said pressure face and door handle shoe away from each other, and to force said pressure face firmly against said jamb while simultaneously forcing said door handle shoe against said door handle.

2. The door restraint mechanism as set forth in claim 1 wherein said lever actuated means includes a spring for transmitting the force tending to move said pressure face and door handle shoe apart.

3. The door restraint mechanism as set forth in claim 2 wherein said lever may be moved from an unlocked no pressure position, to a locked pressure applied position, and wherein said lever is in an over-center position when in said locked position to maintain the application of force through said spring.

4. The door restraint mechanism as set forth in claim 1 wherein said pressure face includes an opening for the passage of a door bolt therethrough.

5. The door restraint mechanism as set forth in claim 1 wherein said pressure face includes a protrusion for extending into an opening therefor in a striker plate positioned on said jamb opposite said pressure face.

6. The door restraint mechanism as set forth in claim 1 wherein said frame includes a first and second tubular frame member secured to each other in spaced apart parallel relation, said frame members straddling said door handle, said pressure face extending between said frame members.

7. The door restraint mechanism as set forth in claim 6 wherein said lever actuated means includes a pair of springs, each mounted in a different one of said tubular frame members, for transmitting the force tending to move said pressure face and door handle shoe apart.

8. The door restraint mechanism as set forth in claim 7 wherein said lever may be moved from an unlocked no pressure position, to a locked pressure applied position, and wherein said lever is in an over-center position when in said locked position to maintain the application of force through said springs.

9. The door restraint mechanism as set forth in claims 6 or 7 including an auxiliary pressure face plate hingedly secured to said pressure face for selective movement into and out of engagement with said pressure face, said face plate including an opening for the passage of a door bolt therethrough.

* * * * *